United States Patent [19]

Noguchi

[11] Patent Number: 4,634,820

[45] Date of Patent: Jan. 6, 1987

[54] QUICK-BREAK ELECTRICAL SWITCH WITH RECTILINEARLY MOVABLE PLUNGER ACTUATOR

[75] Inventor: Masayoski Noguchi, Tottori, Japan

[73] Assignee: Omron Tateisi Electronics Co., Kyoto, Japan

[21] Appl. No.: 674,748

[22] Filed: Nov. 26, 1984

[30] Foreign Application Priority Data

Nov. 24, 1983 [JP] Japan ..... 58-181872[U]
Dec. 19, 1983 [JP] Japan ..... 58-195956[U]

[51] Int. Cl.[4] ..... H01H 15/00

[52] U.S. Cl. ..... 200/16 A; 200/67 R; 200/DIG. 42

[58] Field of Search ..... 200/16 R, 16 A, 16 B, 200/16 C, 16 D, DIG. 42, 67 R, 67 DB, 76, 70, 67 DA, 153 P, 153 PA, 67 B, 1 V

[56] References Cited

U.S. PATENT DOCUMENTS 3,562,463 9/1971 Charbonneau et al. ..... 200/67 B
4,347,415 8/1982 Falchi ..... 200/67 DB

FOREIGN PATENT DOCUMENTS 0033869 8/1981 European Pat. Off. .

*Primary Examiner*—A. D. Pellinen
*Assistant Examiner*—Morris Ginsburg
*Attorney, Agent, or Firm*—Stevens, Davis, Miller & Mosher

[57] ABSTRACT

The electrical switch which may be of a type having a toggle mechanism or a buckling mechanism for achieving abrupt motion of its movable piece. The switch is additionally provided with a mechanism for forcibly disengaging a movable contact formed on the movable piece away from a fixed contact even when the movable contact and the fixed contact are welded together due to heat generated from the contacts. This mechanism may conveniently include a pair of rack gears and a pinion gear so that the force applied to the switch is also transmitted to the disengagement mechanism for, in addition to normal switching action, pulling the movable contact away from the fixed contact. The disengagement mechanism may also be formed of other structure, but a favorable result will be obtained if the disengagement mechanism acts upon a middle portion of the movable piece as far away as possible from the contacts because the heat from the contacts may deform the working end of the disengagement mechanisms which is typically made of synthetic resin.

12 Claims, 8 Drawing Figures

QUICK-BREAK ELECTRICAL SWITCH WITH RECTILINEARLY MOVABLE PLUNGER ACTUATOR

BACKGROUND OF THE INVENTION

This invention relates to an electrical switch comprising, a plunger adapted to receive an external axial force thereto and moveable along its axial direction, at least one moveable piece extending substantially normally to the plunger and having at least one moveable contact securely fixed to an end of the moveable piece, a fixed contact securely fixed to a fixed member opposite to the moveable contact, a compression spring means engaged between an intermediate portion of the plunger and an intermediate portion of the movable piece in such a manner that the movable piece may be driven along the axial direction of the plunger through a toggle action of the compression spring means as the plunger is actuated along its axial direction.

An electrical switch of this type may be built in various forms. For instance, the switch may comprise more than one moveable piece and the number of moveable contacts associated therewith may be likewise arbitrarily selected according to the particular needs.

Also more than one fixed contact may be provided and some of them may be normally closed contacts while others may be normally open contacts. Furthermore, the plunger may be provided with a detent mechanism so that the plunger may be held by itself in either one of two or three possible positions, and it is also possible to do away with such a detent mechanism so that the plunger may be in a first position when no force is applied thereto and may move to a second position only when an axial force is applied thereto.

Moreover, the actuation of the plunger may be performed in various forms. It may be adapted to be pushed manually either directly or by way of a lever or other force transmitting means, or, alternatively, it may be adapted to be actuated by another member, for instance, in the form of a limit switch.

In such an electrical switch, particularly when it is connected to an inductive load, sparks are often generated between contacts as they are disengaged and the heat arising from the sparks are often intense enough to melt the contacts. And the pressure acting between the contacts for ensuring low electric resistivity between them often promotes adhesion between the contacts in much the same way as in electric welding.

When this occurs, because the spring force which may be provided for the mechanical switching action of the electrical switch is not enough to disengage the thus mutually welded contacts, and the electrical switch with such mutually welded contacts become totally unusable.

It is known that contacts tend to be progressively degraded as they are used under severe conditions over an extended time period and become more prone to such mutual welding. And the durability of an electrical switch is often determined by this factor.

Furthermore, in an electrical switch of this type, a fault in the compression spring means may render the whole electrical switch unworkable and may cause an extreme inconvenience should such a failure occur when it is strongly necessary to connect or disconnect a certain electric circuit.

SUMMARY OF THE INVENTION

In view of such inconveniences in conventional switches, a primary object of this invention is to provide an electrical switch which has a means for disengaging the mutual welding of contacts, should such welding occur.

Another object of this invention is to provide an electrical switch which is free from welding in its contacts even after use of an extended time period.

Yet another object of this invention is to provide an electric switch which may be still operational for at least either connecting or disconnecting an electric circuit even when a means for actuating its moveable piece becomes faulty.

Yet another object of this invention is to provide an electrical switch which is durable.

According to this invention such objects are accomplished by providing an electrical switch comprising, a plunger adapted to receive an external axial force thereto and moveable along its axial direction, at least one moveable piece extending substantially normally to the plunger and having at least one moveable contact securely fixed to an end of the moveable piece, a fixed contact securely fixed to a fixed member opposite to the moveable contact, a compression spring means engaged between an intermediate portion of the plunger and an intermediate portion of the movable piece in such a manner that the movable piece may be driven along the axial direction of the plunger through a toggle action of the compression spring means as the plunger is actuated along its axial direction, further comprising a disengagement member; and a force transmitting means which may transmit an axial force applied to the plunger to the disengagement means; the disengagement member having a driving surface which may be pressed against the moveable piece along a direction parallel to the motion of the moveable contact away from the fixed contact as the force axially applied to the plunger is transmitted to the disengagement member by way of the force transmitting means.

It is particularly advantageous if the force transmitting means comprises a rack gear formed in a side surface of an extension of the plunger, a pinion gear pivoted to a fixed member and another rack gear which is formed in a side surface of the disengagement member, because the motion of the disengagement member caused by the motion of the plunger is substantially parallel to the latter motion and is therefore oriented in the most preferred direction for disengaging the contacts; i.e. disengaging the mutually welded contacts so as to disengage them by a tensile force rather than a shearing force.

According to this particular aspect of the invention, because the disengagement member is moved by a gear mechanism including rack gears and pinion gears for linear motion of the disengagement member and the working end of the disengagement member pushes the moveable piece in a normal direction, i.e. without any tangential component, thereby substantially reducing the possibility of wear in the working end of the disengagement member, there is indeed very little wear from use over an extended time period not only in the working end of the disengagement member but also in the mechanism for transmitting the force of the plunger to the moveable piece and, therefore, reliable disengagement action is available even after using it for a very long time.

Furthermore, since the disengagement member may engage with the central portion of the moveable piece for disengaging the moveable contacts away from the fixed contacts, the working end of the disengagement member is not directly subjected to the heat from the contacts and suffers less deformation from heat, thereby withstanding the use over an extended time period.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings are all of them given purely for the purpose of explanation and exemplification only, and are none of them intended to be limitative of the present invention in any way, since the scope of the present invention is to be defined solely by the legitimate and proper scope of the appended claims.

In the drawings, like parts and features are denoted by like reference numerals in the various figures thereof, and.

DESCRIPTION OF THE PREFERRED EMBODIMENTS

Figure 1:
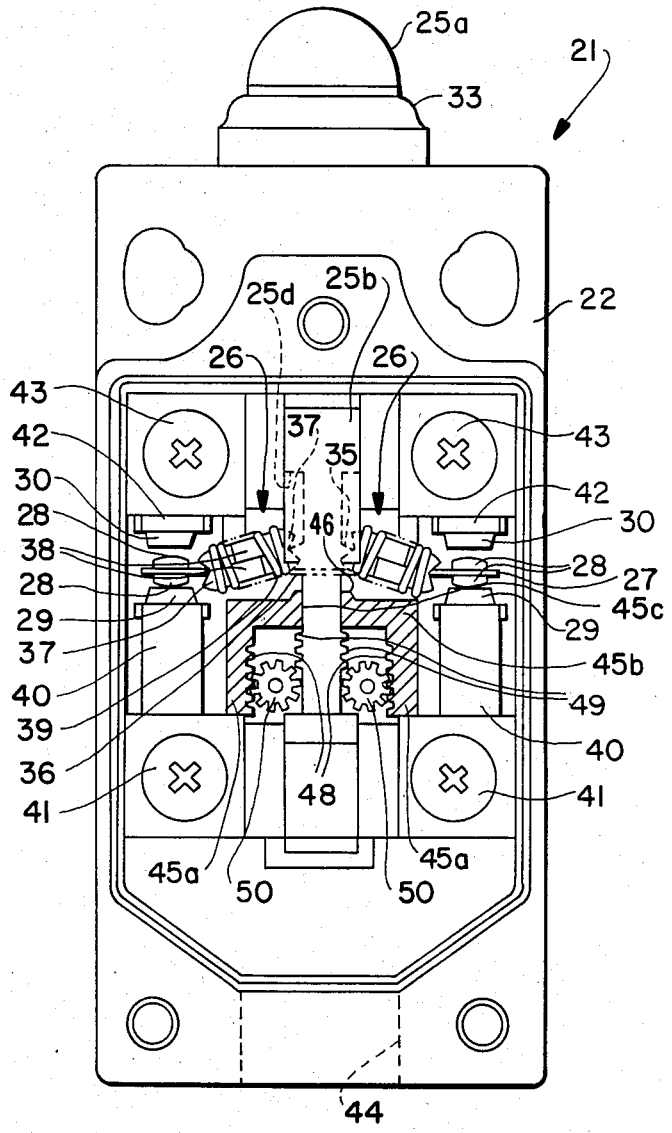
FIG. 1 is a partially sectional front view of an embodiment of the present invention with an outer cover and an inner cover removed.
Figure 2:
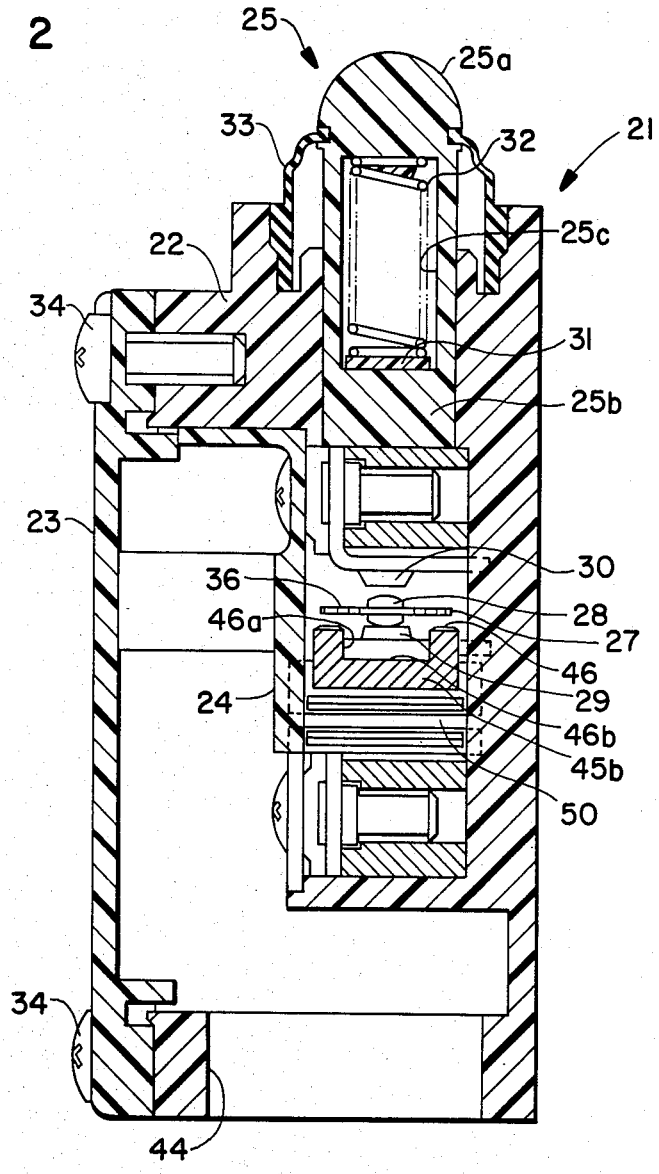
FIG. 2 is a sectional view of the electrical switch of FIG. 1.

With reference to FIGS. 1 and 2, a switch 21 comprises a case 22, an external cover 23, an internal cover 24, a plunger 25, a pair of toggle assemblies 26, 26, a moveable piece 27, a pair of moveable contacts 28, 28, a pair of normally closed contacts 29, 29 and a pair of normally open contacts 30, 30.

The above-mentioned plunger 25, having a semispherically formed upper end **25*a* and a prismatically formed shaft portion 25*b*, is inserted through an upper portion of the case 22 in an axially movable manner. The upper portion of the shaft portion 25*b* is provided with a laterally extending through bore 25*c* and a stopper plate 31 securely fixed to the case 22 is passed therethrough. A compression coil spring 32 is interposed, within the bore 25*c*, between the lower surface of the upper end 25*a* of the plunger 25 and the upper surface of the stopper plate 31, thus biasing the plunger 25 upwardly and defining the upper limit of the axial motion of the plunger 25**.

A sleeve 33 made of rubber or rubber-like elastomer is fitted between the upper semi-spherical portion **25*a* of the plunger 25 and the upper central opening of the case 22 receiving the shaft portion 25*b* of the plunger 25**, for sealing purpose.

The case 22 receiving the plunger 25 therethrough has a relatively large cavity in its lower portion, and the external cover 23 is fitted over the front opening of the cavity with an appropriate sealing member interposed therebetween by means of screws 34, in a detachable manner.

The two side surfaces of the middle portion of shaft portion **25*b* of the plunger 25 are each formed with a cavity 25*d*, and a projection 35 is integrally formed in the bottom of each of these cavities 25*d*. And a moveable piece 27 made of appropriate sheet metal and extending laterally relative to the plunger 25 has a rectangular central hole 36 receiving the shaft portion 25*b* of the plunger 25** therethrough.

The toggle assemblies 26 are interposed between the projections 35 and the corresponding lateral ends of the rectangular hole 36 of the moveable piece 27.

The toggle assemblies 26, 26 are formed by sliders 38, 38 having flanges 37, 37 and a compression coil spring 39. The sliders 38, 38 are disposed with their flanges 37, 37 facing outwardly and their shaft portions adjoining each other laterally, and with their shaft portion passed through the coil spring 39 and their flanges 37, 37 engaging the two ends of the coil spring 39, so that the flanges 37, 37 may move towards each other against the spring force of the compression coil spring 39 when an axial compressive force is applied thereto.

The moveable contacts 28, 28 are fixedly secured to the two ends of the moveable piece 27 and the normally closed contacts 29, 29 are provided opposingly therebelow. These normally closed contacts 29, 29 are fixedly secured to fixed terminals 40, 40 which are in turn fixedly secured to the case 22 by insert molding, and mounting screws 41, 41 for attaching lead wires (not shown in the drawings) to the fixed terminals 40, 40 are fastened thereto.

The normally open contacts 30, 30 oppose the moveable contacts 28, 28 thereabove. These normally open contacts 30, 30 are fixedly secured to fixed terminals 42, 42 which are in turn fixedly secured to the case 22 by insert molding, and mounting screws 43, 43 for attaching lead wires (not shown in the drawings) to the fixed terminals 42, 42 are fastened thereto.

The bottom portion of the case 22 is provided with a through hole 44 for passing the lead wires for the terminals 40, 42 therethrough. The internal cover 24 is mounted in the interior of the case 22 with screws or the like for covering the above-mentioned contacts 28, 29 and 30.

A disengagement member 45, which may be made of synthetic resin, is disposed below and adjacent to the central portion of the moveable contact piece 27, and this disengagement member 45 comprises a pair of legs **45*a* and a bridge member 45*b* integrally connecting the upper ends of the legs 45*a*. The bridge member 45*b* is provided with a through hole 45*c* for receiving the lower portion of the shaft portion 25*b* of the plunger 25. The upper surface 46 of the bridge member is provided with a projection 46*a* with a flat top surface and a laterally extending groove 46*b***.

Furthermore, the mutually opposing inner surfaces of the two legs **45*a*, 45*a* are each provided with a rack gear 48 and the lateral side surfaces of the lower portion of the shaft portion 25*b* of the plunger 25 opposing the rack gears 48 are provided with similar rack gears 49. A pair of pinion gears 50 pivotally attached to the case 22 and the inner cover 24 are interposed between each of the corresponding pairs of the rack gears 48, 49 in such a manner that the downward vertical motion of the plunger 25 is transmitted to the disengagement member 45** as its upward vertical motion, and vice versa.

Now the action of this embodiment is described in the following with reference to FIGS. 1 to 4.

Figure 3:
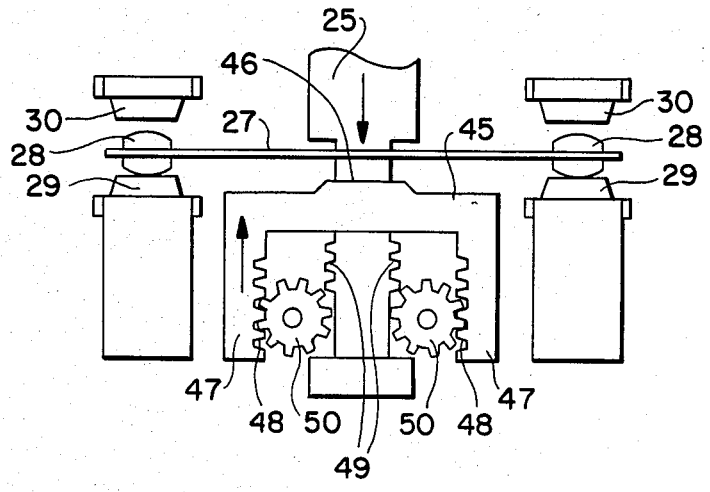
FIGS. 3 and 4 are front views showing a part of FIG. 1 in a magnified scale for showing the action of a force transmitting means for a disengagement member.
Figure 4:
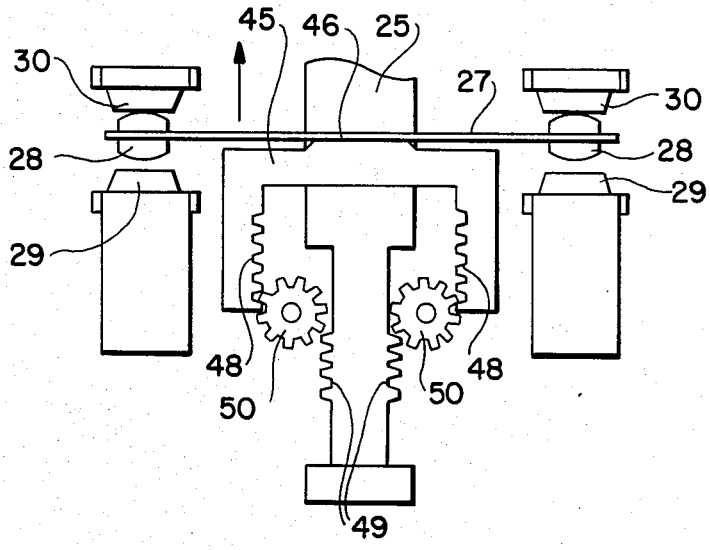
Figure 5:
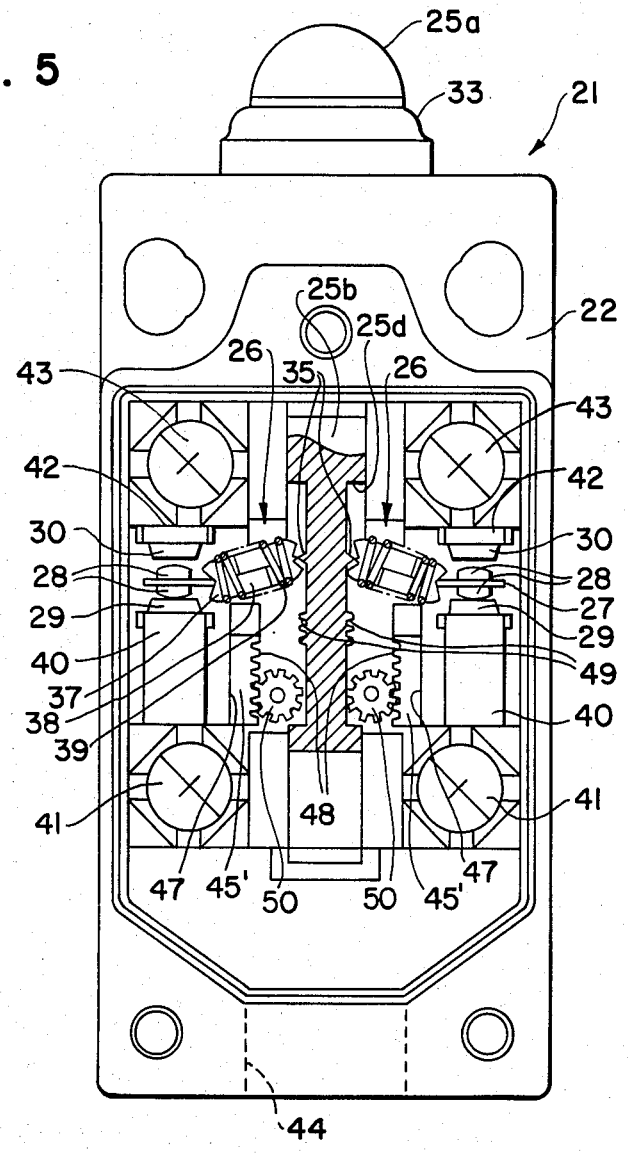
FIG. 5 is a partially sectional front view of another embodiment of the present invention with an outer cover and an inner cover removed.
Figure 6:
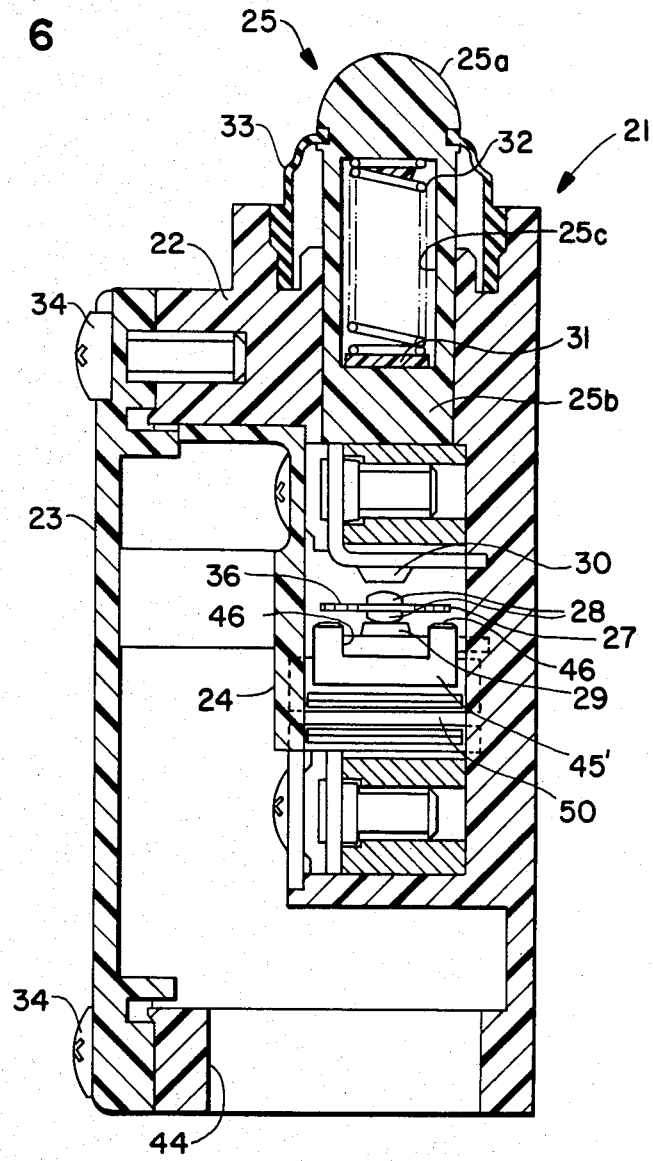
FIG. 6 is a sectional view of the electrical switch of FIG. 5.
Figure 7:
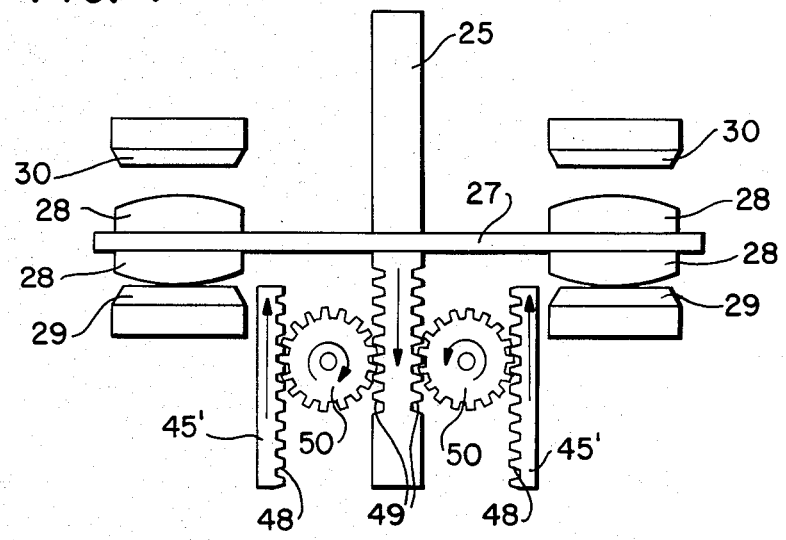
FIGS. 7 and 8 are front views showing a part of FIG. 1 in a magnified scale for showing the action of a force transmitting means for a disengagement member.
Figure 8:
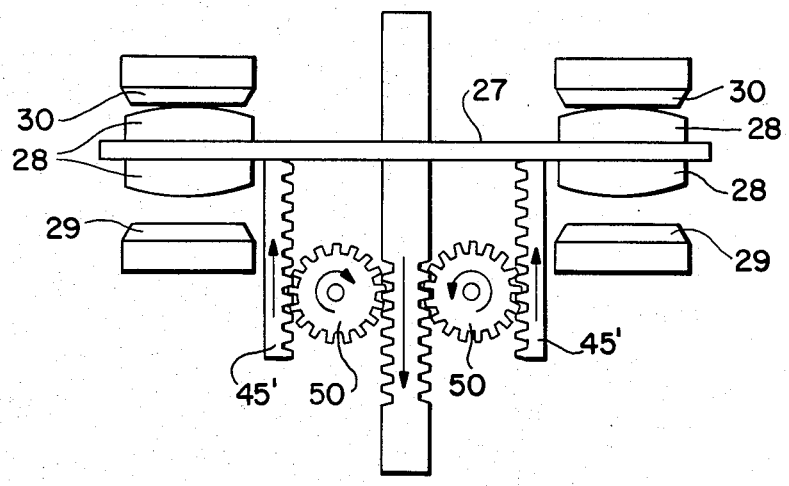

When no force is applied to the plunger 25, the various parts of the switch 21 are positioned as shown in FIGS. 1 to 3 and the spring force of the compression coil springs 39 includes a component which biases the moveable piece 27 downwards and, hence, the moveable contacts against the normally closed contacts 29, 29.

When a downward force is applied to the upper semispherical portion 25*a* of the plunger 25, the plunger 25 is pushed downwards against the spring force of the return spring 32 and this downward motion of the plunger 25 causes the compression of the coil springs 39 of the toggle assemblies 26. When the compression coil springs 38 are compressed to a certain extent, the toggle assemblies 26 abruptly buckle downwardly. This buckling action occurs rather abruptly because the spring force of the coil springs 39 opposes the downward motion of the plunger 25 until the buckling occurs and, once this buckling has occurred, the spring force of the compression coil springs 38 assists the downward motion of the plunger 25.

Once this buckling occurs, then the spring force of the coil spring 39 biases the moveable piece upwardly and, hence, the moveable contacts 28 against the normally open contacts 30. Because this switch over occurs abruptly with the buckling of the toggle assemblies 26, the properties desired for an electrical switch may be attained.

At the same time, the downward motion of the plunger 25 causes the meshing of the rack gears 48 with the pinion gears 50 and the meshing of the pinion gears 50 with the rack gears 49 of the disengagement member 45, thereby pushing the disengagement member 45 upwards through transmission of the force applied to the semispherically formed upper end 25*a* of the plunger to the disengagement member 45. As a result, projection 46a in the central portion of the upper surface 46 of the disengagement member 45 pushes the central portion of the moveable piece 27 upwards, i.e. in the same direction as the moveable contacts 28 are disengaged from the normally closed contacts 29, with the toggle assemblies 26 received within the lateral groove 46*b* of the upper surface 46 of the disengagement member 45 and not obstructing the upward motion of the disengagement member 45.

As a result, if the moveable contacts 28, 28 are welded to the normally closed contacts 29, 29, the moveable contacts 28, 28 are pushed upwards away from the normally closed contacts 29, 29 and may be forcibly disengaged therefrom.

When the downward pushing force on the plunger 25 is relieved, the plunger 25 moves upwards under the spring force of the return coil spring 32 and against the spring force of the coil springs 39 of the toggle assemblies 26, and this upward motion of the plunger 25 causes inverse buckling action of the toggle assemblies 26 and the resultant downward motion of the moveable piece 27 causes the moveable contacts 28, 28 to be switched over from the normally open contacts 30, 30 to the normally closed contacts 29, 29.

In the above-described disengagement action, because the disengagement operation surface or the upper surface 46 of the disengagement member 45 opposes the middle portion of the moveable piece 27, the moveable contacts 28, 28 are relatively free from the influence of heat which is often generated in the contacts and, therefore, from the deformation which may have been caused by such heat.

FIGS. 5 to 8 show another embodiment of the electric switch of this invention. This embodiment is very similar to the previously described embodiment, but, in this embodiment, the disengagement member is comprised of a pair of disengagement rods 45' and each of the disengagement rods is provided with a rack gear 48 identical to those in the previous embodiment. Each of the disengagement rods 45' are guided along a fixed guide surface 47 of the case 22 for stable vertical motion. An appropriate means for preventing the disengagement rods 45' from being removed away from the guide surface 47 may be provide, for instance, in the form of a combination of a groove and a corresponding projection with a shape of an inverted trapezoid fitted together in a complementary manner.

According to this embodiment, the disengagement rods 45' apply an upward force to the moveable piece 27 at two points on each side of the center thereof. Therefore, this embodiment provides an advantage over the previous one in that the moveable piece 27 may be made of relatively thinner or more flexible material than in the previous embodiment because the force applied to the moveable piece is more distributed than in the previous embodiment in addition to the advantage that the assembly thereof is more facilitated because the shaft portion 25*b* of the plunger 25 need not to be passed through the disengagement member.

Although the present invention has been shown and described in terms of the preferred embodiments thereof, and with reference to the illustrative drawings, it should not be considered as limited thereby. Various possible modifications and alternatives could be conceived of by one skilled in the art to any particular embodiment, without departing from the scope of the invention.

As a matter of fact, although in the abovedescribed embodiment a concrete and preferred structure of the toggle assemblies 26 was described, they may be formed in many different ways, for instance, by forming the moveable piece 27 from a sheet spring member and by cutting out and pulling up toggle assemblies therefrom.

Also, in the second embodiment, while the disengagement member was described as being comprised of two separate disengagement rods, it is also possible to integrally connect the upper ends of the disengagement rods 45 without losing the advantage of the embodiments by providing projections right above the disengagement rods so that the force may be transmitted to the moveable piece 27 in the same way as in the second embodiment.

Therefore it is desired that the scope of the invention should be defined not by any of the perhaps purely fortuitous details of the shown preferred embodiments, or of the drawings, but solely by the scope of the appended claims, which follow.

What is claimed is:

1. An electrical switch comprising, a plunger adapted to receive an external axial force applied thereto and movable along its axial direction, at least one movable piece extending substantially normal to the plunger and having at least one movable contact securely fixed to an end of the movable piece, a fixed contact securely fixed to a fixed member opposite to the movable contact, a compression spring means engaged between an intermediate portion of the plunger and an intermediate portion of the movable piece such that the movable piece is driven along the axial direction of the plunger through a toggle action of the compression spring means as the plunger is actuated along its axial direction, said switch further comprising:

a disengagement member; and a force transmitting means comprising rack and pinion gear means for transmitting said axial force applied to the plunger to the disengagement member;

the disengagement member having a driving surface for pressing against the movable piece along a direction parallel to the motion of the movable contact away from the fixed contact as the axial force applied to the plunger is transmitted to the disengagement member by the force transmitting means.

2. An electrical switch comprising, a plunger having an operational end for receiving an external force applied thereto and moving the plunger along its axial direction, at least one movable piece extending substantially normal to the plunger and having at least one movable contact securely fixed to an end of the movable piece, a first fixed contact securely fixed to a fixed member opposite to the movable contact, a compression spring means engaged between an intermediate portion of the plunger and an intermediate portion of the movable piece that the movable piece is driven along the axial direction of the plunger through a toggle action of the compression spring means as the plunger is actuated along its axial direction, said plunger further comprising an extension comprising a first rack gear, said switch further comprising:

a disengagement member having a rack gear means extending parallel to the first rack gear; and a pinion gear interposed between and meshed with the first rack gear and said rack gear means and pivoted to a fixed member, the disengagement member having a driving surface for pressing against the movable piece along a direction parallel to the motion of the movable contact away from the fixed contact as the axial force applied to the operational surface of the plunger is transmitted to the disengagement member by the first rack gear, the pinion gear and said rack gear means.

3. An electrical switch as defined in claim 2, wherein the moveable piece is provided with a said moveable contact on each of its two ends.

4. An electrical switch as defined in claim 3, wherein additional contacts are provided adjacent to the moveable contacts so as to oppose the moveable contacts from the side opposite to that of the first fixed contact.

5. An electrical switch as defined in claim 4, wherein the first rack gear is disposed in each side surface of said plunger, the disengagement member comprises two rods which comprise the rack gear means, said two rods being guided along an axial direction in a slidable manner.

6. An electrical switch as defined in claim 5, wherein the two rods are each guided along a fixed member.

7. An electrical switch as defined in claim 6, wherein the rods include top ends which are adapted to engage the moveable piece at a certain equal distance away from the center of the moveable piece.

8. An electrical switch as defined in claim 7, wherein the ends of the two rods nearer to the moveable piece are integrally connected by a bridge member.

9. An electrical switch as defined in claim 5, wherein the two rods are each guided along a side surface of an extension of the plunger.

10. An electrical switch as defined in claim 9, wherein the two rods include ends nearer to the movable piece which are integrally connected by a bridge member.

11. An electrical switch as defined in claim 10, wherein the two rods are guided along the vertical direction by way of an opening provided in the bridge member said opening receiving the extension of the plunger therethrough.

12. An electrical switch as defined in claim 11, wherein said bridge member includes a central projection with a substantially flat top.

* * * * *